US006503326B1

(12) United States Patent
Mikelionis

(10) Patent No.: US 6,503,326 B1
(45) Date of Patent: Jan. 7, 2003

(54) HYGIENIC TOILET PACK

(76) Inventor: Raymond J. Mikelionis, 203 Grove St., Roseville, CA (US) 95678

( * ) Notice: Subject to any disclaimer, the term of this patent is extended or adjusted under 35 U.S.C. 154(b) by 152 days.

(21) Appl. No.: 09/653,343

(22) Filed: Aug. 31, 2000

(51) Int. Cl.[7] ..... B05C 3/12

(52) U.S. Cl. ..... 118/419; 118/423; 206/233; 206/494; 242/598.5; 242/598.6

(58) Field of Search ..... 118/423, 420, 118/419; 242/598.5, 598.6; 206/233, 812, 494; 221/45

(56) References Cited

U.S. PATENT DOCUMENTS

| | | | | | |
|---|---|---|---|---|---|
| 4,004,687 | A | * | 1/1977 | Boone | 118/506 |
| 5,217,576 | A | | 6/1993 | Van Phan | 162/158 |
| 5,311,986 | A | | 5/1994 | Putz | 206/233 |
| 5,439,521 | A | | 8/1995 | Rao | 118/415 |
| 5,456,421 | A | | 10/1995 | Reed | 242/598.2 |
| 5,618,008 | A | | 4/1997 | Dearwester et al. | 242/594.5 |
| 5,660,313 | A | | 8/1997 | Newbold | 225/42 |
| 5,765,717 | A | | 6/1998 | Gottselig | 221/45 |
| 5,950,960 | A | | 9/1999 | Marino | 242/594.5 |
| 5,951,762 | A | | 9/1999 | Shangold et al. | 118/405 |
| 5,971,138 | A | | 10/1999 | Soughan | 206/210 |
| 6,056,235 | A | * | 5/2000 | Brozinsky | 242/598.6 |

* cited by examiner

*Primary Examiner*—Laura Edwards
(74) *Attorney, Agent, or Firm*—Thomas R. Lampe

(57) ABSTRACT

A hygienic toilet pack includes a roll of toilet tissue and a roll of flexible sheet material disposed end to end and of a size to fit in a conventional toilet tissue roll holder. The sheets forming the rolls are doubled over to provide inner and outer sheet segments in registry with one another. The sheets of the flexible sheet material are moistened with a hygienic agent.

18 Claims, 4 Drawing Sheets

HYGIENIC TOILET PACK

TECHNICAL FIELD

This invention relates to a product to be utilized as a toilet wipe. The product can be mounted on an ordinary toilet tissue roll holder and allows alternative use of toilet tissue or flexible sheet material impregnated with a moist or wet hygienic agent.

BACKGROUND OF THE INVENTION

Toilet tissue rolls are in widespread usage in bathrooms, public restrooms and other locations. Typically, rolls of toilet tissue are comprised of interconnected sheets of tissue separated by lines of weakness, the sheets being removed by unrolling the tissue and applying pulling forces thereto to obtain sheet separation.

It is known to provide wet toilet wipes either instead of or in association with ordinary toilet tissue and the following United States patents are believed to be representative of the current state of the prior art in this connection: U.S. Pat. No. 5,618,008, issued Apr. 8, 1997, U.S. Pat. No. 5,217,576, issued Jun. 8, 1993, U.S. Pat. No. 5,950,960, issued Sep. 14, 1999, U.S. Pat. No. 5,311,986, issued May 17, 1994, U.S. Pat. No. 5,765,717, issued Jun. 16, 1998, U.S. Pat. No. 5,439,521, issued Aug. 8, 1995, U.S. Pat. No. 5,971,138, issued Oct. 26, 1999, U.S. Pat. No. 5,660,313, issued Aug. 26, 1997, U.S. Pat. No. 5,951,762, issued Sep. 14, 1999, and U.S. Pat. No. 5,456,421, issued Oct. 10, 1995.

Prior art arrangements allowing for the alternative dispensing of either dry ordinary toilet tissue or wet toilet wipes often require a special holder or container for the products. In many instances, conventional toilet tissue dispensers cannot be utilized at all or utilized efficiently; also, wet wipes and dispensers therefor can be complex and relatively expensive, not lending themselves to home use on a regular basis.

DISCLOSURE OF INVENTION

The present invention relates to a hygienic toilet pack that is characterized by its relative low cost and simplicity of structure and operation. The hygienic toilet pack can be utilized with an ordinary toilet tissue roll holder to selectively dispense either dry toilet tissue or wet or moistened flexible sheet material.

The hygienic toilet pack includes a double-ended roll of toilet tissue comprised of a plurality of interconnected toilet tissue sheets spirally wound and centered about a central toilet tissue roll axis. Each toilet tissue sheet is folded along a toilet tissue fold line orthogonally disposed relative to the central toilet tissue roll axis and includes an inner toilet tissue sheet segment and an outer toilet tissue sheet segment in overlapping relationship and extending from the toilet tissue fold line.

Each of the inner toilet tissue sheet segments and each of the outer toilet tissue sheet segments have a free distal end spaced from and substantially parallel to the toilet tissue fold line.

The hygienic toilet pack also includes a double-ended roll of flexible sheet material disposed next to the roll of toilet tissue with one of the ends of the roll of flexible sheet material closely adjacent to one of the ends of the roll of toilet tissue.

The roll of flexible sheet material comprises a plurality of interconnected flexible sheet material sheets spirally wound and centered about a central flexible sheet material roll axis. The central toilet tissue roll axis and the central flexible sheet material roll axis are substantially co-axial.

Each flexible sheet material sheet is folded along a flexible sheet material fold line orthogonally disposed relative to the central flexible sheet material roll axis and includes an inner flexible sheet material sheet segment and an outer flexible sheet material sheet segment in overlapping relationship and extending from the flexible sheet material fold line.

Each of the inner flexible sheet material sheet segments and each of the outer flexible sheet material sheet segments has a free distal end spaced from and parallel to the flexible sheet material fold line. At least some of the flexible sheet material sheets incorporate a hygienic agent.

Other features, advantages, and objects of the present invention will become apparent with reference to the following description and accompanying drawings.

MODES FOR CARRYING OUT THE INVENTION

Figure 1:
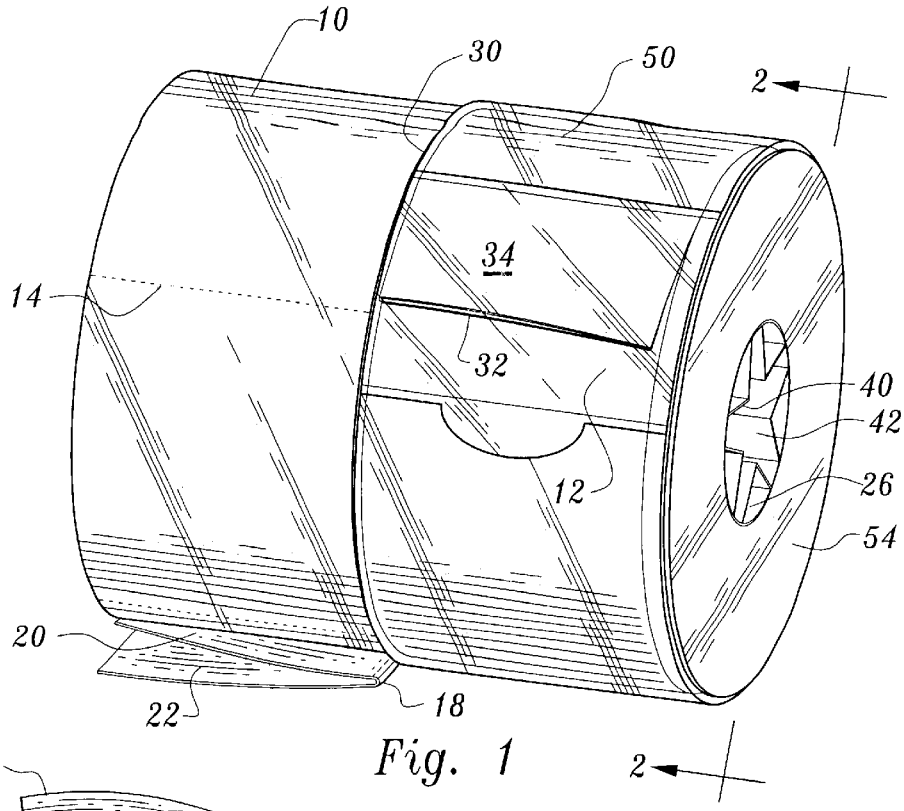
FIG. 1 is a perspective view of a hygienic toilet pack constructed in accordance with the teachings of the present invention.
Figure 2:
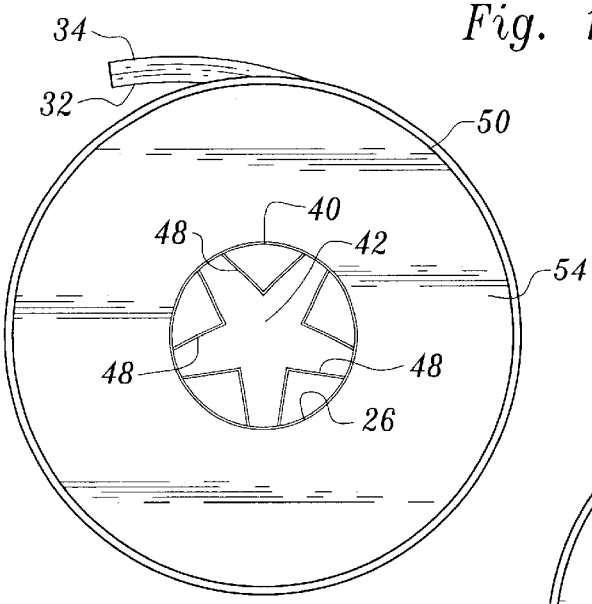
FIG. 2 is a side elevational view of the pack as taken in the direction of double headed arrow 2—2 in FIG. 1 showing a support tube centrally disposed in the rolls of the pack.

Referring now to FIGS. 1–5 and 12, a hygienic toilet pack constructed in accordance with the teachings of the present invention is illustrated, the pack including a double-ended roll 10 of toilet tissue and a double-ended roll 12 of flexible sheet material.

The toilet tissue of roll 10 is of conventional material and comprised of a plurality of interconnected toilet tissue sheets separated by perforation lines 14. The tissue is spirally wound and centered about a central toilet tissue roll axis to form a central opening 16.

The roll 10 differs from a conventional roll of toilet tissue in that each toilet tissue sheet is folded along a toilet tissue fold line 18 orthogonally disposed relative to the central toilet tissue roll axis. Each toilet tissue sheet includes an inner toilet tissue sheet segment 20 and an outer toilet tissue sheet segment 22. The toilet tissue sheet segments 20, 22 are in overlapping relationship and extend from the toilet tissue fold line 18. In the illustrated embodiment of FIG. 1, the inner and outer segments of each toilet tissue sheet are in registry. Each of the inner toilet tissue sheet segments and each of the outer toilet tissue sheet segments have a free distal end spaced from and parallel to the toilet tissue fold line.

The roll of flexible sheet material 12 is disposed next to roll 10 with one of the ends of the roll of flexible sheet material closely adjacent to one of the ends of the roll of toilet tissue. The rolls 10, 12 are disposed end to end but are separated by a liquid resistant barrier member which will be described below.

The material of roll 12 can be of any suitable nature such as toilet tissue, a non-woven fabric, woven fabric or any other suitable material. The sheets of roll 12 are impregnated with a liquid hygienic agent; that is, the sheets are pre-moistened with a liquid or semi-liquid so that the flexible sheet material can be employed to provide hygienic cleansing during use. Suitable hygienic materials are petroleum jelly, glycerin, witch hazel, benzackonium chloride, benzethonium chloride, etc., or combinations thereof. The term "hygienic agent" as employed herein refers to any material that will moisten the flexible sheet material and contribute to cleansing or have a therapeutic effect. Such materials include cleansers, soapy solutions, moisturizers or even water.

Figure 7:
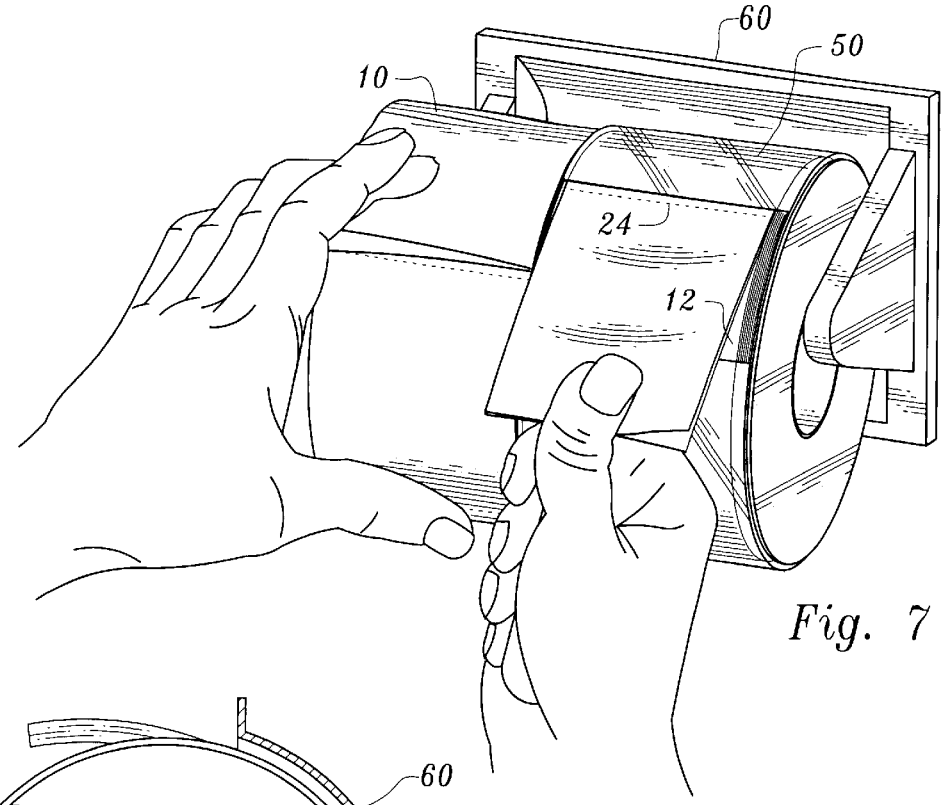
FIG. 7 is a perspective view illustrating an alternative form of hygienic toilet pack supported by a conventional toilet tissue roll holder and showing a sheet of flexible sheet material being dispensed from one of the rolls of the pack.

Roll 12 is comprised of a plurality of interconnected flexible sheet material sheets separated by lines of weakness. FIG. 7 depicts a roll 12 of flexible sheet material having lines of weakness in the form of perforation lines 24. These lines of weakness 24 are not observable in FIGS. 1–4 and 12 but are incorporated in the roll 12 shown therein.

The plurality of interconnected flexible sheet material sheets of roll 12 are spirally wound and centered about a central flexible sheet material roll axis. The roll 12 has a central opening 26. The central toilet tissue roll axis and the central flexible sheet material roll axis are co-axial and the openings 16 and 26 are in substantial alignment.

Each flexible sheet material sheet of roll 12 is folded along a flexible sheet material fold line 30 orthogonally disposed relative to the central flexible sheet material roll axis. Each sheet of roll 12 includes an inner flexible sheet material sheet segment 32 and an outer flexible sheet material sheet segment 34. The sheet segments 32, 34 of each sheet are in overlapping relationship, in registry, and extend from the flexible sheet material fold line 30. Each of the inner and outer flexible sheet material sheet segments has a free distal end spaced from and parallel to the flexible sheet material fold line.

Openings 16, 26 of the rolls 10, 12 receive a roll support in the form of a support tube 40 extending through the openings to maintain the openings in alignment.

Figure 3:
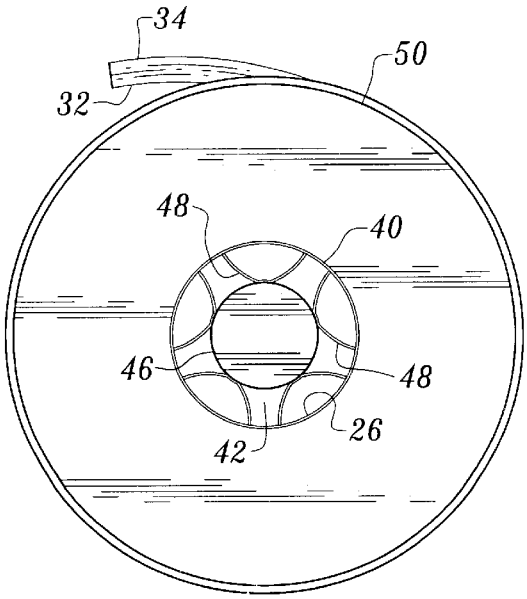
FIG. 3 is a view similar to FIG. 2 but illustrating a toilet tissue holder element positioned in the support tube and frictionally engaging inwardly projecting flexible resilient elements of the support tube.
Figure 4:
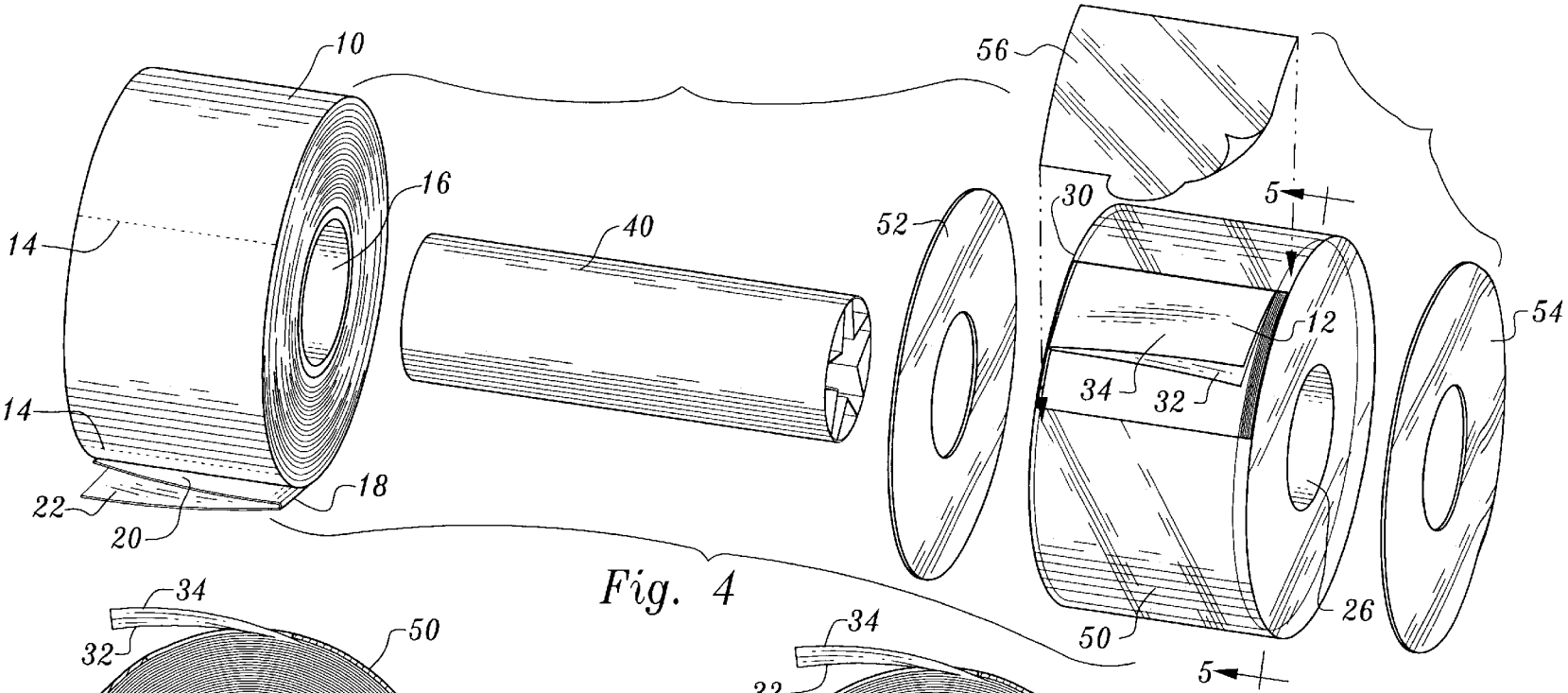
FIG. 4 is an exploded, perspective view illustrating structural elements of the hygienic toilet pack of FIG. 1.

Support tube 40 is hollow and defines a passageway 42 for receiving a holder element of a holder for a standard roll of toilet tissue. In FIG. 3 such a holder element is in the form of a boss 46 of a standard toilet tissue holder used to frictionally retain a standard toilet tissue roll in position. It will be appreciated that there are two such bosses, each entering a different end of support tube 40. The bosses 46 are sized to deform the resilient elements 48 of support tube 40 which project inwardly into the passageway 42. The bosses 46 and the support tube projections thus serve to provide some frictional resistance to rotation of the support tube along with the rolls mounted thereon.

Figure 12:
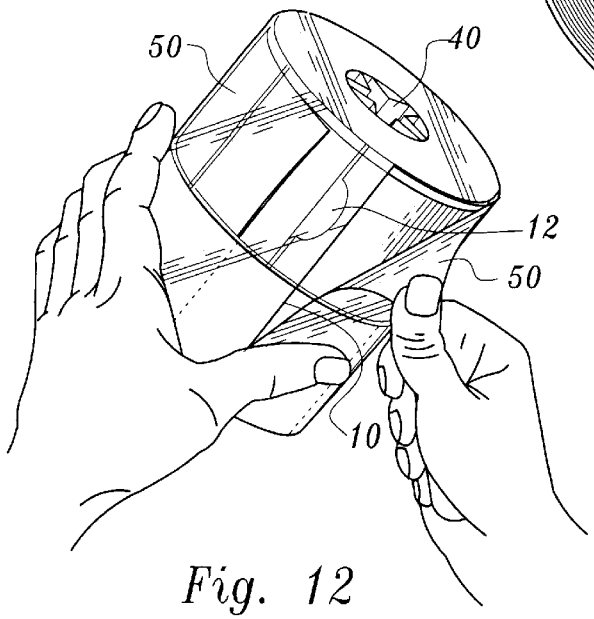
FIG. 12 is a perspective view of the hygienic toilet pack of FIG. 1 showing an overwrap being removed therefrom.

As shown in FIG. 12, the rolls 10, 12 can be sold together as a unit along with support tube 40, the rolls being covered by an overwrap 50 which is removed prior to installation of the rolls on a toilet roll holder.

The roll of toilet tissue and the roll of flexible sheet material when disposed end to end have a combined length not exceeding the length of a standard roll of toilet tissue whereby the hygienic toilet pack can be mounted as a unit on a holder for a standard roll of toilet tissue.

It is to be noted that the rolls 10 and 12 are mounted in reverse orientation. That is, roll 10, as viewed in the direction of double-headed arrow 2 in FIG. 1 rotates in a clockwise direction to unwind or dispense the sheets thereof while roll 12 must be rotated in a counter clockwise direction to dispense sheets of flexible sheet material therefrom. This means that rotation and dispensing from one of the rolls will not cause rotation of the other rolls in such a manner as to inadvertently dispense from that other roll.

As indicated above, the roll 12 is moistened with a hygienic material and it is important to package roll 12 in such a manner as to prevent drying out thereof prior to use and also to prevent migration or transfer of the wet hygienic agent to roll 10. For this purpose, a liquid-resistant cover is provided for roll 12. The cover may, for example, be formed of semi-rigid wax paper or semi-rigid plastic sheet material. In any event, the cover includes a cylindrical cover portion 50 and disk portions 52, 54 disposed at the ends of the roll 12. The disk portions have central openings for receiving support tube 40. Disk portion 52 acts as a liquid-resistant barrier member to prevent migration of moist hygienic agent from roll 12 to roll 10 while disk portion 54 serves to prevent drying or escape of the moistening agent from the other end of the roll 12. The cylindrical cover portion and disk portions are secured together by any desired expedient. Cylindrical cover portion 50 has a segment 56 that is torn away just prior to usage of the roll 12 to expose the lead end of the roll of flexible sheet material, as shown in FIG. 6.

In the hygienic toilet pack embodiment illustrated in FIG. 1, the shapes and sizes of the outer peripheries of the ends of the roll of toilet tissue and the roll of flexible sheet material are substantially identical prior to unwinding thereof with the outer peripheries of the disk portions 52, 54 substantially corresponding in shape and size to the shapes and sizes of the ends.

Figure 6:
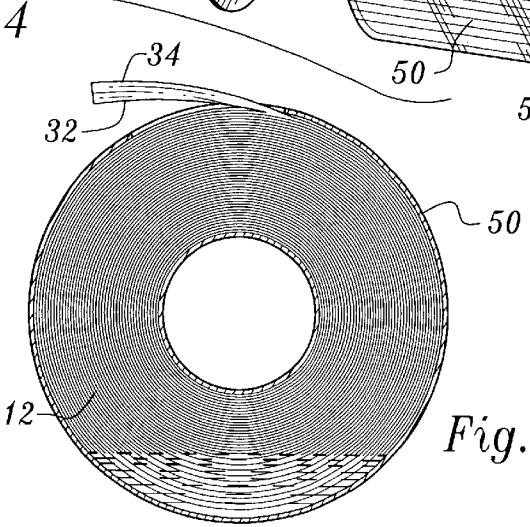
FIG. 6 is a view similar to FIG. 5 but illustrating an alternative embodiment.
Figure 5:
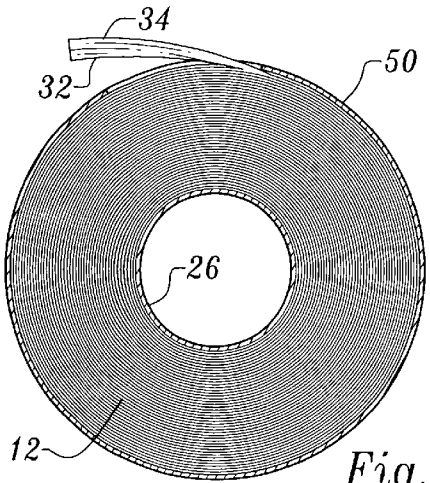
FIG. 5 is a side elevational view taken in the direction of double headed arrow 5—5 in FIG. 4.

FIG. 6 is virtually identical to FIG. 5 but illustrates a situation wherein the hygienic agent is sufficiently moist to cause a pooling of liquid agent at the bottom of the cover of the roll 12. In these circumstances the cover comprised of portions 50, 52 and 54 is sufficiently liquid tight to prevent leakage.

Figure 8:
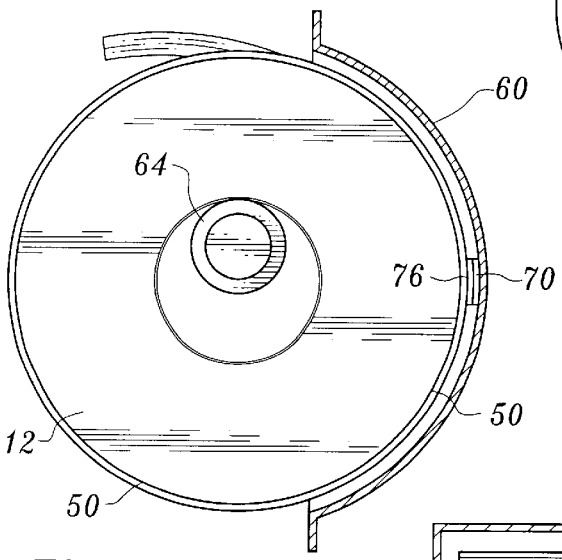
FIG. 8 is a side elevational view in partial cross-section of the arrangement of FIG. 7.
Figure 9:
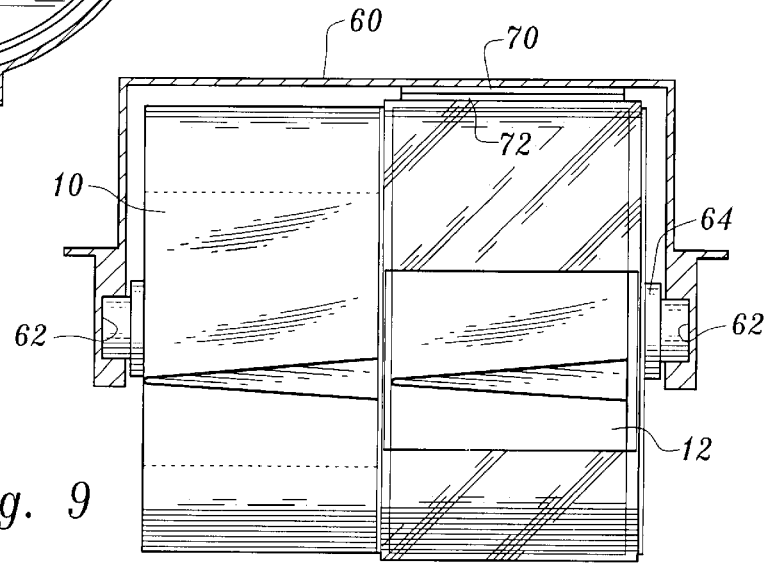
FIG. 9 is a top plan view in partial cross-section of the arrangement of FIG. 7.

FIGS. 7–9 illustrate the roll of toilet tissue 10 and roll of flexible sheet material 12 mounted on a conventional toilet tissue roll holder 60 of the type which has spaced receptacles 62 supporting the ends of a roll support spindle 64. In this arrangement the support tube 40 is not utilized, the rolls 10, 12 defining openings which receive the roll support spindle 64.

In the embodiment of FIGS. 7–9, strips 70, 72 of synthetic material that is releasably secured when pressed together, such as the material sold under the trademark Velcro, are affixed respectively to the inner surface of holder 60 and the outer surface of cover 50. This will prevent rotation of cover 50 when flexible sheet material is being pulled therefrom as shown in FIG. 7 so that the opening in cover 50 caused by removal of segment 56 remains at a fixed location. The user can prevent rotation of roll 10 by applying manual pressure thereto as shown in FIG. 7.

Figure 10:
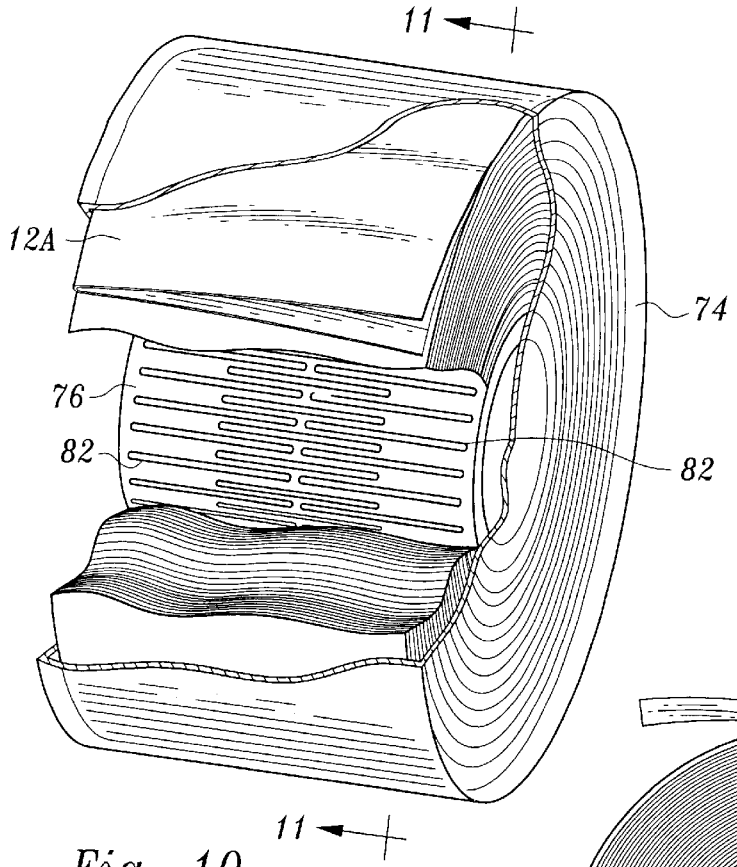
FIG. 10 is a perspective view, with a portion thereof broken away, of a roll of flexible sheet material having an insert at the center thereof defining a chamber containing a liquid hygienic agent.
Figure 11:
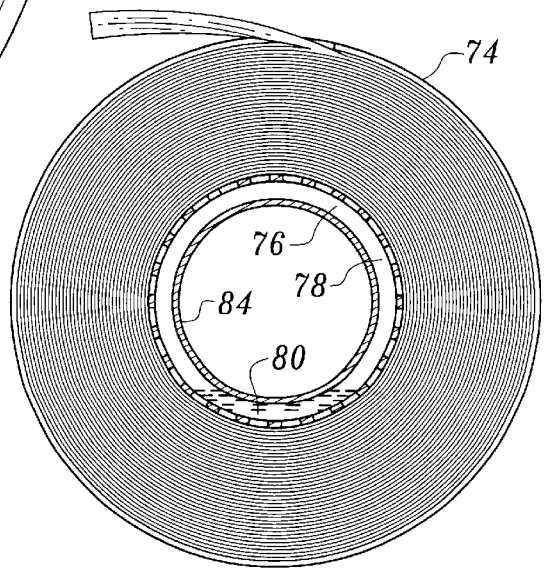
FIG. 11 is a side elevational view in partial cross-section of the roll of FIG. 10 as viewed in the direction of double-headed arrow 11—11.

FIGS. 10 and 11 illustrate a roll of flexible sheet material 12A disposed in a waterproof cover 74 which has an insert 76 in communication with the innermost convolution of the roll. The insert 76 is co-axially disposed relative to the central flexible sheet material roll axis and defines a chamber 78 containing a liquid hygienic agent 80. Small openings 82 provide communication between the chamber and the innermost convolution of flexible sheet material forming the roll to allow transfer of the liquid hygienic agent from the chamber to roll 12A by capillary action. The innermost wall 84 of the insert 76 can accommodate either a toilet tissue roll support spindle, such as previously described spindle 64, or a support tube, such as support 40 previously described, which receives bosses of a standard toilet tissue holder.

The invention claimed is:

1. A hygienic toilet pack comprising, in combination:

a double-ended roll of toilet tissue comprised of a plurality of interconnected toilet tissue sheets spirally wound and centered about a central toilet tissue roll axis, each toilet tissue sheet being folded along a toilet tissue fold line orthogonally disposed relative to said central toilet tissue roll axis and including an inner toilet tissue sheet segment and an outer toilet tissue sheet segment in overlapping relationship and extending from said toilet tissue fold line, each of said inner toilet tissue sheet segments and each of said outer toilet tissue sheet segments having a free distal end spaced from and substantially parallel to said toilet tissue fold line; and a double-ended roll of flexible sheet material disposed next to said roll of toilet tissue with one of the ends of said roll of flexible sheet material closely adjacent to one of the ends of said roll of toilet tissue, said roll of flexible sheet material comprised of a plurality of interconnected flexible sheet material sheets spirally wound and centered about a central flexible sheet material roll axis, said central toilet tissue roll axis and said central flexible sheet material roll axis being substantially co-axial, each flexible sheet material sheet being folded along a flexible sheet material fold line orthogonally disposed relative to said central flexible sheet material roll axis and including an inner flexible sheet material sheet segment and an outer flexible sheet material sheet segment in overlapping relationship and extending from said flexible sheet material fold line, each of said inner flexible sheet material sheet segments and each of said outer flexible sheet material sheet segments having a free distal end spaced from and parallel to said flexible sheet material fold line, the flexible sheet material impregnated with a hygienic agent wherein said toilet tissue and folded flexible sheet material are supported next to each other and are seperated from each other by a barrier.

2. The hygienic toilet pack according to claim 1 wherein said roll of toilet tissue and said roll of flexible sheet material are disposed end to end and separated by a liquid resistant barrier member to prevent migration of said hygienic agent from said roll of flexible sheet material to said roll of toilet tissue.

3. The hygienic toilet pack according to claim 2 additionally comprising a selectively removable overwrap covering said roll of toilet tissue, said roll of flexible sheet material and said liquid resistant barrier member.

4. The hygienic toilet pack according to claim 2 wherein said liquid resistant barrier member comprises a disk formed of liquid resistant material and having a central opening for receiving a support for said roll of toilet tissue and said roll of flexible sheet material.

5. The hygienic toilet pack according to claim 4 wherein the shapes and sizes of the outer peripheries of the ends of said roll of toilet tissue and said roll of flexible sheet material are substantially identical prior to unwinding thereof and wherein the outer periphery of said disk substantially corresponds in shape and size to the shapes and sizes of the ends.

6. The hygienic toilet pack according to claim 1 wherein said roll of toilet tissue and said roll of flexible sheet material are disposed end to end and have a combined length not exceeding the length of a standard roll of toilet tissue whereby said hygienic toilet pack can be mounted on a holder for a standard roll of toilet tissue.

7. The hygienic toilet pack according to claim 6 wherein said roll of toilet tissue and said roll of flexible sheet material each define an opening passing therethrough, said openings being in communication and extending respectively along the central toilet tissue roll axis and central flexible sheet material roll axis thereof, said openings for receiving a roll support.

8. The hygienic toilet pack according to claim 7 additionally comprising a roll support received by said openings and maintaining said openings in alignment.

9. The hygienic toilet pack according to claim 8 wherein said roll support includes a support tube extending through said openings, said support tube defining a passageway for receiving holder elements of a holder for a standard roll of toilet tissue.

10. The hygienic toilet pack according to claim 1 additionally comprising a liquid-resistant cover covering said roll of flexible sheet material, said cover including a cover segment releasably connected to the remainder of said cover and selectively removable from the remainder of said cover to expose a lead end of said roll of flexible sheet material.

11. The hygienic toilet pack according to claim 10 wherein said cover includes disk-shaped, liquid resistant cover ends located adjacent to and covering the opposed ends of said roll of flexible sheet material.

12. The hygienic toilet pack according to claim 9 wherein said support tube includes at least one inwardly projecting flexible resilient element at said passageway for frictionally engaging at least one of said holder elements.

13. The hygienic toilet pack according to claim 6 wherein one of said rolls is positioned for clockwise rotation on said holder during dispensing therefrom and the other of said rolls is positioned for counter clockwise rotation on said holder during dispensing therefrom.

14. The hygienic toilet pack according to claim 10 additionally including releasable attachment means for releasably attaching said cover to a holder for said hygienic toilet pack to prevent movement of said cover relative to said holder during rotation of and dispensing from said roll of flexible sheet material.

15. The hygienic toilet pack according to claim 14 wherein said hygienic agent is liquid, at least some of said liquid disposed at the bottom of said cover and engageable by sheets of said roll of flexible sheet material upon rotation thereof during dispensing of said flexible sheet material.

16. The hygienic toilet pack according to claim 1 additionally comprising an insert positioned in an opening formed at the center of said roll of flexible sheet material and co-axially disposed relative to said central flexible sheet material roll axis, said insert defining a chamber containing a liquid hygienic agent and additionally defining one or more openings providing communication between said chamber and the innermost convolution of flexible sheet material forming said roll of flexible sheet material.

17. The hygienic toilet pack according to claim 1 additionally comprising a liquid-resistant cover at least partially covering said roll of flexible sheet material and means for preventing rotation of said cover during rotation of said roll of flexible sheet material during dispensing therefrom when said roll of flexible sheet material is rotatably mounted on a roll holder.

18. The hygienic toilet pack according to claim 16 wherein said insert defines a plurality of small openings allowing transfer of liquid hygienic agent from said chamber to said roll of flexible sheet material by capillary action.

* * * * *